United States Patent [19]

Tselesin

[11] Patent Number: 5,049,165

[45] Date of Patent: Sep. 17, 1991

[54] COMPOSITE MATERIAL

[76] Inventor: Naum N. Tselesin, 2900 Lookout Pl., Atlanta, Ga. 30305

[21] Appl. No.: 467,958

[22] Filed: Jan. 22, 1990

Related U.S. Application Data

[63] Continuation-in-part of Ser. No. 303,924, Jan. 30, 1989, Pat. No. 4,925,457.

[51] Int. Cl.[5] ..... B24D 11/00

[52] U.S. Cl. ..... 51/295; 51/296; 51/308; 51/309

[58] Field of Search ..... 51/295, 296, 308, 309

[56] References Cited

U.S. PATENT DOCUMENTS

| | | | |
|---|---|---|---|
| 3,402,514 | 9/1968 | Johnson | 51/293 |
| 3,906,684 | 9/1975 | Marshall et al. | 51/295 |
| 3,942,959 | 3/1976 | Markööet al. | 51/295 |
| 4,047,902 | 9/1977 | Wiand | 51/295 |
| 4,163,647 | 8/1979 | Swiatek | 51/295 |
| 4,317,660 | 3/1982 | Kramis et al. | 51/295 |
| 4,543,106 | 9/1985 | Parekh | 51/296 |
| 4,826,508 | 5/1989 | Schwartz et al. | 51/295 |
| 4,964,884 | 10/1990 | Jürisseu et al. | 51/296 |

*Primary Examiner*—William R. Dixon, Jr.
*Assistant Examiner*—Willie J. Thompson
*Attorney, Agent, or Firm*—James B. Middleton

[57] ABSTRACT

A composite material is formed of a carrier having a cellular structure and diamonds or other hard, abrasive particles received within the cellular structure. A matrix material holds the diamonds in the carrier, and the matrix material may be the carrier itself or an additional substance such as a metal powder or resin. The diamonds may protrude from the composite material for aggressive working, or may be embedded for longer life of the material. The cellular carrier has a skeleton that protects and mechanically supports the diamonds within the composite material for greater durability of the composite material.

23 Claims, 4 Drawing Sheets

COMPOSITE MATERIAL

CROSS REFERENCE TO RELATED APPLICATION

This application is a continuation-in-part of the copending application by Peter T. DeKok and Naum N. Tselesin, titled "Abrasive Tool and Method for Making", filed Jan. 30, 1989, Ser. No. 303,924 now U.S. Pat. No. 4,925,457.

INFORMATION DISCLOSURE STATEMENT

It is well known to embed diamonds and other hard substances within a matrix to provide cutting and polishing tools. Cutting tools are commonly made by placing diamond chips in a matrix material such as a metal powder or resin. The matrix material may then be compressed and sintered, or sintered without compression, to hold the diamonds securely. It will be understood that this well known technique yields a product with diamonds randomly distributed therethrough, and there is little that can be done to provide otherwise.

Another technique for providing cutting or polishing tools utilizes electroplating. In general, diamonds are placed on a metal surface, and metal is electroplated onto the metal surface, successive layers being plated until the diamonds are fixed to the metal surface by the plated metal. While this technique allows the diamonds to be in a regular pattern if desired, the individual stones are usually set by hand which is very time consuming. Also, though the electroplated tools have met with considerable commercial success, such tools are somewhat delicate in that the stones are fixed to the tool only by the relatively thin layers of metal, and there can be only a single layer of diamonds to act as the cutting surface. It will be recognized that a preshaped tool loses its shape as further layers of metal are deposited, so there is a practical limit to the number of layers of metal deposited.

There have been numerous efforts to produce an abrasive tool wherein the carrier for the diamonds, or other hard particles, is flexible. Such a tool is highly desirable for polishing non-flat pieces, or for fixing to a contoured shaping device such as a router. The prior art efforts at producing a flexible tool have normally comprised a flexible substrate, diamonds being fixed thereto by electroplating. For example, small diamond chips have been fixed to the wires of a wire mesh, the wire mesh providing the flexibility desired. Also, small dots of nickel having diamond chips fixed thereto by electroplating have been carried on a flexible foam. The foam provides the flexibility, and the nickel dots are separated sufficiently to maintain the flexibility.

In both flexible and non-flexible tools of the prior art, a problem has been the easy loss of the diamonds or other hard particles. In the prior art arrangements, the removal of one particle frequently causes loss of support for other, adjacent, stones, so the adjacent stones are quickly lost.

The prior art is without a system for holding each stone, or particle, firmly within a matrix without substantial dependence on adjacent stones. The prior art is also lacking in means for providing a particular pattern of stones without hand setting and electroplating or the like for holding the stones in position.

SUMMARY OF THE INVENTION

This invention relates generally to abrasive and wear resistant materials, and is more particularly concerned with a composite material having hard particles retained in a carrier, the carrier having a cellular structure for supporting the particles.

The present invention provides a composite material including a carrier having a cellular structure, with hard particles located primarily in the cells of the carrier.

A matrix material holds the hard particles in the carrier, and the matrix material may be either integral with, or in addition to, the carrier. The hard particles may consist of carbides, nitrides, carborundum, diamond, or other material hard enough to effect the desired cutting or grinding or polishing. The carrier may be formed of metals, metal alloys, filled plastics or rubber and the like. The concentration of the hard particles in the carrier can be varied widely, the particle sizes and cell sizes being selected to allow the desired number of particles per unit volume and the desired quality.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
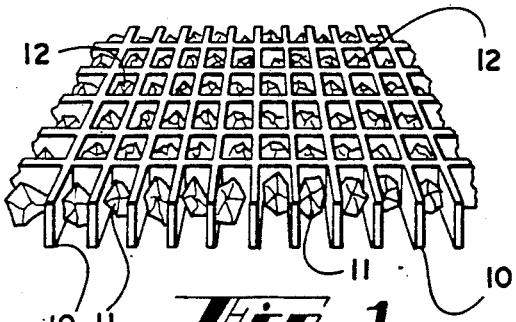
FIG. 1 is a perspective view of one form of composite material made in accordance with the present invention, the material including an integral, cellular carrier having particles within the cells thereof, the matrix material being omitted for clarity.

Referring now more particularly to the drawings, and to those embodiments of the invention here chosen by way of illustration, FIG. 1 shows a cellular carrier 10 having a plurality of particles 11 in the cells of the carrier. As here shown, there are particles 11 in most of the cells of the cellular carrier 10, but those skilled in the art will realize that this is a matter of choice. If less concentration of particles is desired, more cells will have no particles. For maximum concentration of particles, all cells will have particles.

It should further be understood that the cellular carriers shown are by way of illustration only, and are not intended to be exhaustive of the cellular carrier materials. In the above identified co-pending application, the materials disclosed include preformed metal fiber, or metal powder, and woven wire mesh. These materials are intended in the present application, but many additional materials are also included. Thus, in FIG. 1, the cellular carrier is shown as having an egg crate configuration, but the actual skeletal structure may be formed of woven wire, or wires otherwise fastened together, as by welding or soldering. Further, the cellular carrier may take the form of expanded material, punched, perforated or drilled material, extruded material, or virtually any other material that comprises a plurality of cells formed by some type of skeletal structure. Moreover, the cells do not necessarily extend completely through the carrier, but may comprise holes that are open only at their tops. Besides the variety of metal materials, cellular carriers can be made from cemented carbides, ceramics, and organic and fiber graphite materials.

The hard particles also include a great variety of materials. Diamonds are of course well known and frequently used in cutting or abrasive materials, but numerous other hard substances are also useful. For example, one might use cubic boron nitride, boron carbide, tungsten carbide or other carbides, or crushed cemented carbide, as well as aluminum oxide or other ceramics. Also, mixtures of these substances can be used as abrasive materials. In the event the composite material is to be used as a wear surface rather than a cutting or abrasive surface, round stones can be used. Those skilled in the art will realize that round diamonds are diamonds that have been tumbled so that the diamonds themselves tend to smooth the diamonds. Other stones may be similarly rounded.

In using a carrier material such as that shown in FIG. 1, it will be understood that the particles can be somewhat dumped onto the carrier, and the excess raked off. This will leave the particles that are within the cells 12. More elaborate systems may be used if desired, especially if the concentration of particles 11 in the carrier is critical.

With the particles 11 in the cells 12 of the carrier 10, something must be done to hold the particles in the carrier so the material is usable as an abrasive or cutting tool. It is contemplated that a matrix material will serve to encapsulate the particles, at least partially, and to hold the particles to the skeleton of the carrier 10. Any of the well known materials can be used as the matrix material, such as metal powders, metal fiber compositions, or powder and fiber mixtures, all either free or preformed. The matrix material can substantially fill the cells 12, sufficiently to encapsulate the particles. The entire device can be sintered, with or without compression, or brazed or plasma sprayed, to bind the grains or fibers of the matrix material together and hold the particles 11 in place in the carrier 10. Alternatively, depending on the final characteristics desired, the matrix material may be a resin, rubber or the like. A thermoplastic can be used, the thermoplastic being heated to encapsulate the particles, and subsequently cooled to hold the particles in place. A thermosetting resin can be used, the cells 12 being filled with the resin, the material then being heated, probably with some compaction or vacuum processing, to hold the particles 11 in place.

The matrix may contain some residual porosity and be acceptable, the porosity being in the range of 5–50%, including open porosity. The pores in the matrix can be filled with a material different from the matrix, for example with a liquid or a solid lubricant. However, the best retention of hard particles is achieved at less that 5% porosity of the matrix.

The structure shown in FIG. 1 is generally illustrative of the composite material of the present invention, and many variations are possible. Some of the variations are illustrated in FIGS. 2–14.

Figure 2:
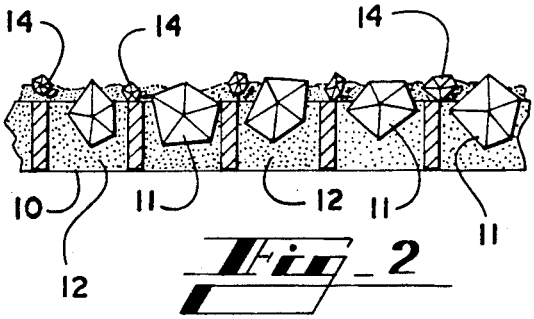
FIGS. 2–13 are cross-sectional views showing various modifications of the structure illustrated in FIG. 1.

FIG. 2 shows a structure similar to the structure of FIG. 1, and the similar parts carry the same reference numerals. Thus, there is a single particle 11 in each cell 12 of the cellular carrier 10. In FIG. 2, the matrix material is indicated by the stippling within the cells 12. It will be noted that at least some of the particles 11 protrude from the carrier 10 on at least one side of the carrier. The additional feature illustrated by FIG. 2 is the combination of particles 14 fixed to the skeleton of the carrier 10.

One may utilize the prior art technique of electroplating or spraying to hold the particles 14 to the carrier 10; however, one might also utilize the matrix material to secure these particles, In the latter case, the matrix material will extend beyond the carrier 10 to encapsulate the particles 14 as well as the particles 11.

Figure 3:
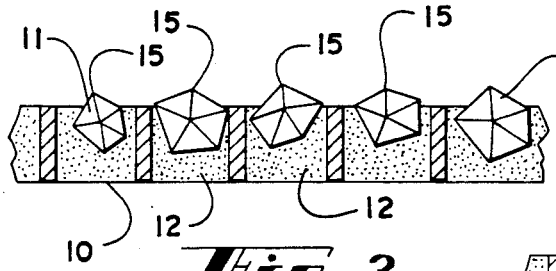
Figure 4:
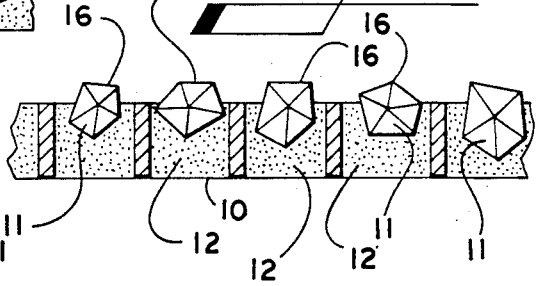

FIG. 3 is also similar to FIG. 1. The difference shown in FIG. 3 is the orientation of the majority of the particles 11 to have a point 15 facing generally outwardly of the carrier 10. FIG. 4 is about the same as FIG. 3 but showing orientation wherein the majority of the particles 11 has a facet 16 facing generally outwardly of the carrier 10.

Any time the hard particles are to be arranged in an orderly pattern, a piece of cellular carrier may be used to arrange the particles in accordance with the teaching in the above identified co-pending application. Material as shown in FIG. 1 can be filled with particles, the material laid on another cellular carrier, and the first carrier removed to leave the particles in a regular pattern.

Figure 5:
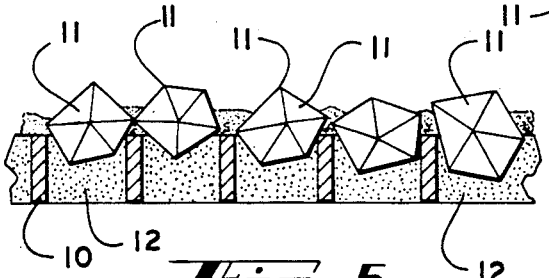

FIG. 5 illustrates a carrier 10 having cells 12 that are smaller than the particles 11. As a result, the particles 11 are not totally received within the cells 12. It is important to note, however, that the majority of the particles 11 extend sufficiently into a cell 12 to allow the skeleton of the carrier 10 to lend support to the particle. This is to say that it is not the matrix material alone that supports the hard particles 11; rather, the majority of the hard particle 11 receive mechanical support from the cellular carrier material 10. As before, the matrix material may extend beyond the carrier 10 to encapsulate the hard particles 11.

Figure 6:
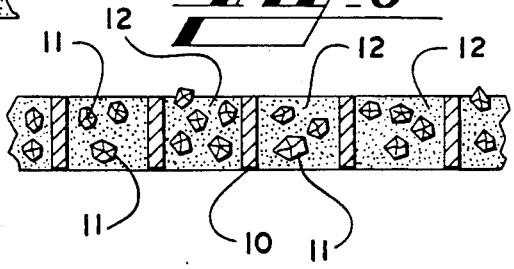

FIG. 6 illustrates a variation of the invention in which the particles 11 are smaller than the cells 12 of the cellular carrier material 10. In FIG. 6, a plurality of particles 11 is within each cell 12 of the carrier 10 In this embodiment of the invention, not every particle will have direct support from the skeleton of the carrier; however, the composite material will be divided into a plurality of cells, and each cell will have support from the cellular carrier material. Loss of one particle from the matrix material in one cell can do no more than weaken the one cell of the composite material, and other cells will remain intact. It will therefore be understood that the cellular material supports all the hard particles; but, some of the hard particles may be directly supported by the cellular material, and other hard particles may be supported indirectly, through the matrix material.

The desired concentration of hard particles for each cell can be achieved by selecting the cell type and size, and considering the size and geometrical parameters of the hard particles. Maximum concentration of hard particles for each cell can be achieved by force packing of the hard particles into the cell.

Figure 7:
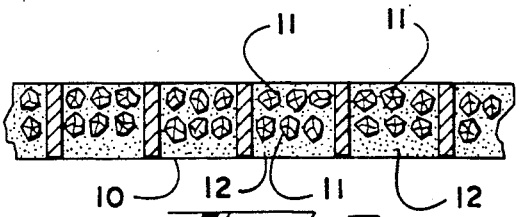
Figure 8:
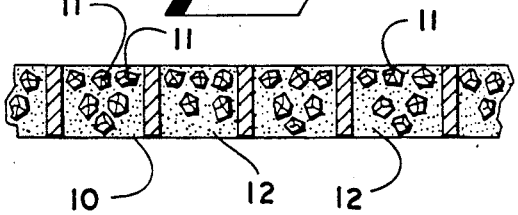

The embodiment of FIG. 7 is almost the same as the embodiment of FIG. 6, except that in FIG. 7 the plurality of particles 11 within each cell 12 is arranged in discrete layers. Such an arrangement provides a more uniform wear pattern; and, by varying the concentration, type, quality and size of particles in each layer, one can control the rate and pattern, or profile, of wear. FIG. 8 shows a variation of FIG. 7 wherein the concentration of particles diminishes in each layer, and the opposite face of the carrier includes at least one layer with no hard particles. Obviously, many additional variations of the layers of particles may be made without departing from the scope of the present invention.

Figure 9:
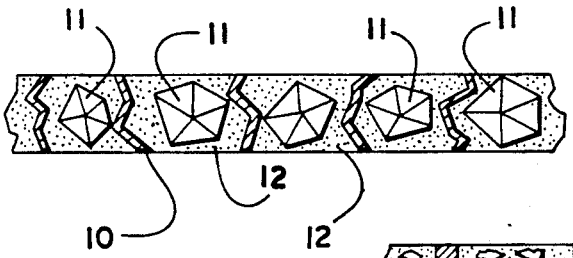

The embodiment shown in FIG. 9 is again similar to the embodiment shown in FIG. 1, but the cellular carrier 10 is here shown as partially crushed. It will be understood that, by using an egg-crate-style carrier 10, particles can be placed into the cells 12, then the skeleton can be crushed to deform the skeleton and assist in retaining the particles within the cells 12. FIG. 9 illustrates a matrix material filling the cells 12, but those skilled in the art will understand that the matrix material may not be required for some composite materials, while it may be necessary for others. The important feature disclosed in FIG. 9 is the deformation of the skeleton of the cellular carrier to assist in mechanically holding the particles 11 within the cells 12. The deformation may be mechanical as is illustrated in FIG. 9, or may be through heat as is disclosed in the above identified co-pending application.

The above descriptions have been concerned with a single piece of cellular carrier material, though the single carrier may have any thickness desired. It should now be understood that one might utilize a plurality of pieces of cellular carrier material bonded together to create a single, composite material.

Figure 10:
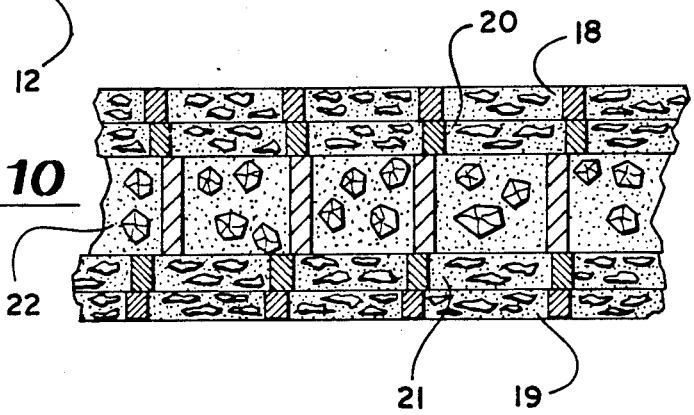

FIG. 10 shows a plurality of layers of composite material made in accordance with the present invention, the several layers being bonded together to create one composite material. As shown in FIG. 10, each side of the material has two layers, each layer having a plurality of particles in each cell as illustrated in FIG. 6. The central portion of the material in FIG. 10 is also formed in accordance with the teaching of FIG. 6, but the central portion has a different cell from the outer layers. Thus, FIG. 10 shows outer layers 18 and 19 bonded to layers 20 and 21. Layers 18–21 are substantially alike, but of course may differ in type and size of particle, as well as concentration of particles, and also type and size of cellular carrier. The central layer 22 has a larger cell, and may have a different concentration of particles 11, including a total absence of particles, and different type and size, as desired. By varying these factors, one can control the rate and profile of wear.

Figure 11:
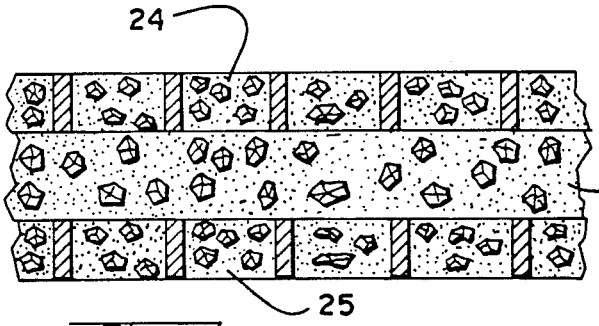

FIG. 11 is similar to FIG. 10, but the outer layers 24 and 25 are bonded to a central layer 26 that does not have a cellular carrier. Such an arrangement may be used to assure that the central layer 26 wears differently from the outer layers 24 and 25. Also, only one outer layer may be used if desired. In this event, the layer 26 will assist in holding the tool together and allow continued performance if the cellular material becomes damaged, thereby preventing a sudden breakdown of the tool.

In the embodiments of the invention shown in FIGS. 9 and 10, it is contemplated that the various layers of the composite material will be constructed as discussed for FIG. 6, then the various layers bonded together. Obviously, one may construct the several layers, then sinter the entire composite material at one time so bonding of the various layers is assured. In the embodiments of the invention shown in FIGS. 12 and 13, it is contemplated that the layers will first be prepared, then the particles pressed thereinto.

Figure 12:
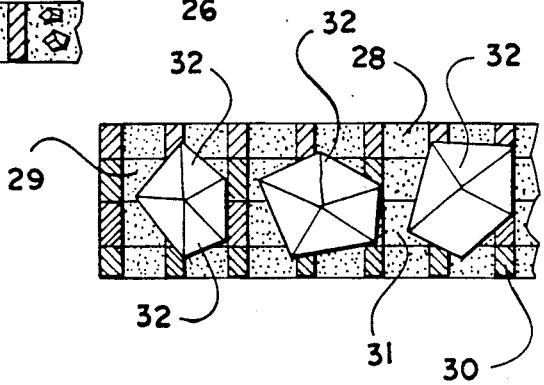

Looking at FIG. 12, there are four layers of cellular carrier material, and a plurality of particles embedded within the four layers. The hard particles are of a size exceeding the cell size of the carrier, and may exceed the cell size in one or more directions. The cells of the carrier are shown as filled with matrix material. Thus, the two layers 28 and 29 can be assembled, and the two layers 30 and 31 similarly assembled. A plurality of particles 32 in a single layer can then be placed between the layers, and the layers urged together, causing the particles 32 to deform the carriers sufficiently for the particles 32 to become embedded within the carriers. The composite can subsequently be sintered or otherwise cured to fix the matrix material.

Figure 13:
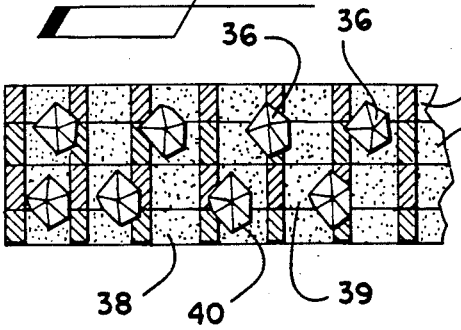

FIG. 13 is similar to FIG. 12, except that carrier layers 34 and 35 have particles 36 contained therein. Carrier layers 38 and 39 have particles 40 contained therein. The four carrier layers are then placed together, and the composite can be sintered or cured to fix the plurality of layers of particles, such as particles 36 and 40, within the matrix, and to fix the plurality of carrier layers together. As in FIG. 12, the hard particles may exceed the size of the cells, but in FIG. 13, there are two pairs of layers that are subsequently fixed together.

Figure 14:
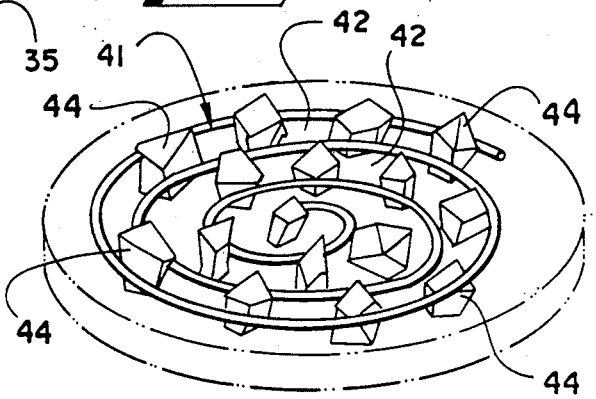
FIG. 14 and 15 are perspective views showing different forms of cellular carriers, the matrix being shown in phantom.

The cellular carrier materials shown and described thus far are very regular in construction and appearance, but other forms of carrier are also contemplated by the present invention. In FIG. 14, the carrier 41 takes the form of a coil of wire. The helical configuration of the carrier 41 provides cells 42 between the turns of the wire so that each particles 44 can be mechanically supported by the skeleton of the carrier. With this construction, it is obvious that a matrix material 45 is necessary to bond the assembly together.

Figure 15:
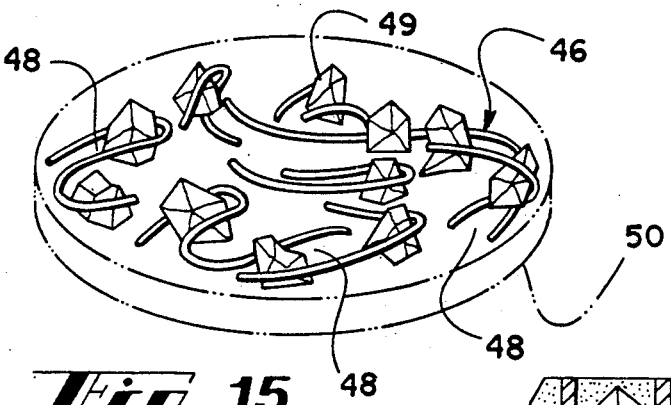

The device shown in FIG. 15 is very similar to that shown in FIG. 14. In FIG. 15 the skeleton of the carrier 46 is formed of wire having rather random contortions rather than the regular arrangement of FIG. 14. The structure and operation are otherwise the same, the bends of the carrier 46 providing cells 48 for receiving and supporting particles 49. Again, a matrix material 50 bonds the structure together. In both FIG. 14 and FIG. 15, it will be understood that the particles 44 and 49 may be fixed to the wires 41 and 46 if desired, e.g. by electroplating or plasma spraying. The wires 41 and 46 can subsequently be bent to form the cells for improved support of the particles.

Figure 16:
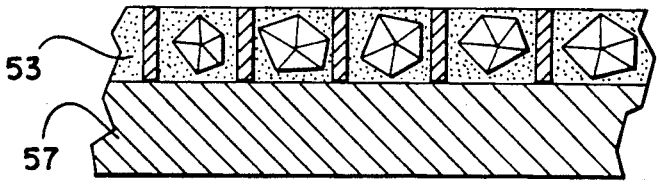
FIG. 16 is a cross-sectional view showing a material made in accordance with the present invention fixed to a substrate

Once a composite material has been made in accordance with the above description, the composite material may be fixed to a substrate in order to lend additional characteristics to the material. The above identified co-pending application discloses a wire mesh welded to a solid substrate. Other substrates may also be used. FIG. 16 illustrates generally a composite material 53 made in accordance with the present invention and fixed to a substrate 57.

The substrate 57 is not illustrated in detail, but those skilled in the art will understand that the substrate 57 may be a cellular or non-cellular material, and may be the same as the carrier, or the same as the matrix, for the material 53, or different therefrom. Also, the composite material 53 may be completed, and subsequently fixed to a substrate, or the composite material 53 and the substrate 57 may be assembled, and the entire assembly sintered or otherwise cured at one time.

From the foregoing, it will be realized that the composite material of the present invention may be made in many different forms, with many different characteristics. FIGS. 17 through 21 of the drawings show some particular applications of the material utilizing the properties of the material.

Figure 17:
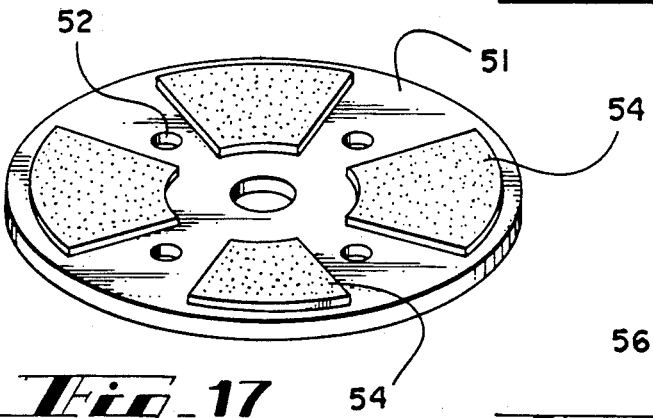
FIG. 17 is a perspective view showing one form of tool utilizing a material of the present invention.

FIG. 17 shows a grinding or sanding disk. The disk 51 constitutes a generally rigid substrate which might have holes 52 therethrough to supply and remove coolant. On at least one surface of the disk 51, pieces of composite material 54 are fixed to effect the grinding or sanding. Material such as that shown in FIG. 1 might be made in advance, and subsequently fixed to the disk 51, though of course the disk 51 may be treated as a substrate similar to the substrate 57 of FIG. 16 so the entire assembly can be bonded together at the same time. With either technique, it will be understood that the concentration of particles, size of particles, type of particles, and arrangement of cellular layers are variable to achieve the desired effects.

Figure 18:
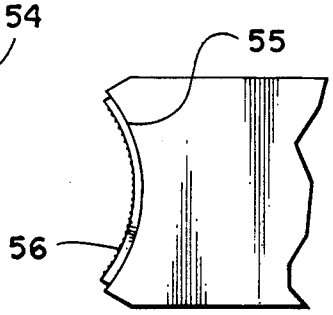
FIGS. 18–21 are side elevational views showing additional tools utilizing the materials of the present invention.

FIG. 18 shows a dressing tool having a curved surface 55 to match the curvature of the piece to be dressed. Composite material 56 is fixed to the curved surface 55. Any of the flexible versions of the present invention can be used. Again, variations will be selected to achieve the desired qualities.

Figure 19:
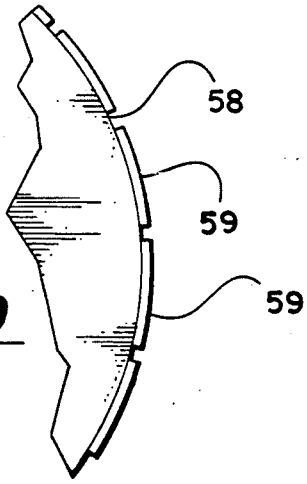

FIG. 19 is somewhat the reverse of FIG. 18, FIG. 19 illustrating a saw having a cutting edge 58. A plurality of strips 59 is fixed to the edge 58 to effect the cutting action of the saw.

Figure 20:
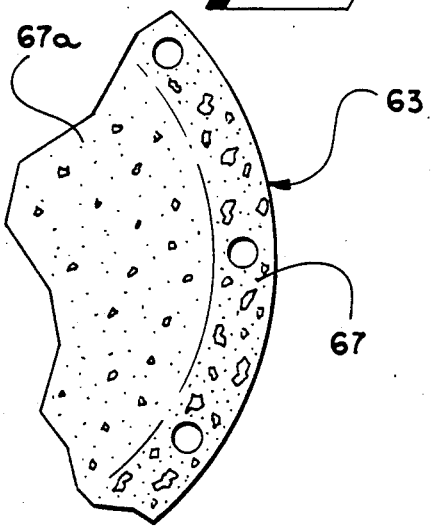

A variation in a saw, or cutting wheel, is shown in FIG. 20. It will be seen that the cutting wheel 63 is divided into two circular portions. The outer portion 67 is formed in accordance with the present invention, and includes diamonds as the hard particle. If the cutting wheel 63 is to cut depths of only a few millimeters, the outer portion 67 will accomplish the cutting, while the inner portion 67*a* simply carries the periphery. Thus, the inner portion can have an inexpensive particle, such as aluminum oxide, rather than diamond. The outer portion 67 may contain through holes or openings to remove dust and chips of machined material, or to conduct liquid coolant through the cutting area.

Figure 21:
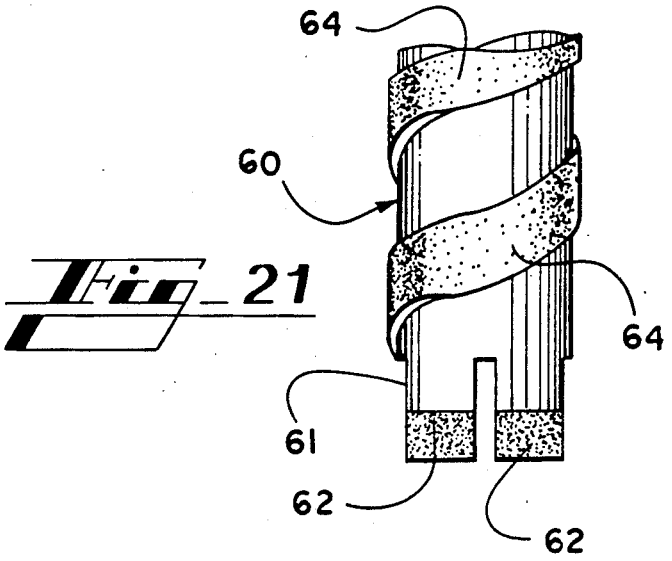

FIG. 21 shows a combination drill and reamer utilizing the composite material of the present invention as the cutting and grinding means. The tool 60 is here shown as generally cylindrical, with a lower cutting portion 61. The lowermost end of the tool 60 is provided with pieces 62 of the composite material of the present invention. The pieces 62 will therefore act as the cutting means and allow the tool 60 to act as a drill.

The side of the tool 60 is provided with strips 64 formed of the composite material of the present invention. The strips 64 may be wound helically around the tool, or may be vertically oriented, or otherwise placed on the tool. Also, the tool itself may be conical if desired, or of some other shape, and the sides of the tool, with the strips 64, can act as a reamer, or cylindrical grinder, depending on the shape of the tool.

Figure 22:
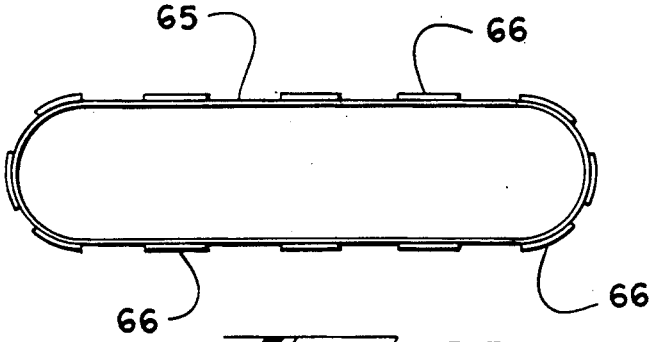
FIG. 22 is a side elevational view of a belt having grinding or polishing plates thereon in accordance with the present invention.
Figure 23:
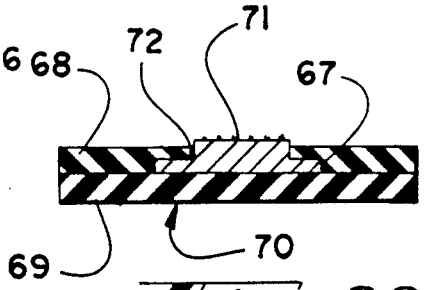
FIG. 23 is a cross-sectional view through a modified form of the belt shown in FIG. 23.

FIG. 22 illustrates a flexible belt 65 having a plurality of grinding pads 66 thereon. As shown in FIG. 22, it is contemplated that the composite material of the present invention will be simply bonded to the belt 65. A modification of this structure is shown in FIG. 23. In FIG. 23 there are two layers 68 and 69 forming the belt 70. The layer 68 defines an opening 67 therein, and the particle-bearing material 71 protrudes through the opening. To hold the material 71 in place, the material 71 is fixed to a substrate 72, the substrate 72 being larger than the hole 67 to be held between the two layers 68 and 69.

Figure 24:
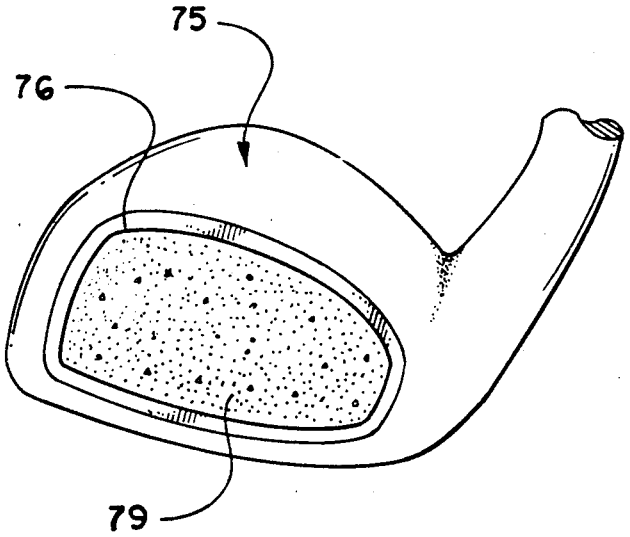
FIG. 24 is a fragmentary view showing a golf club utilizing a piece of material of the present invention on the face thereof.

Finally, FIG. 24 illustrates a golf club head 75 having a face 76. The shaft 78 is shown fragmentarily. Fixed to the face 76 is a piece of material 79, the material 79 being made in accordance with the present invention. Preferably, a relatively thin and flexible material will be made, and subsequently fixed to the face 76 of the head 75. The material may be fixed by an adhesive or the like, or may be removably attached by screws or other releasable fastening means.

After the composite material of the present invention has been completed, there are several surface treatments that may improve the material. The surface treatment may take the form of a decorative coating to render the material attractive and more easily sellable, or may improve the operation of the material in its intended function.

One form of surface treatment includes the coating of the material with nickel, chromium, aluminum oxide, titanium nitride, boron carbide, diamond thin film, or a non-metal such as a polymeric substance. Such coatings may be applied through chemical vapor deposition, physical vapor deposition, ion implantation process, plasma spraying, or brazing.

Other surface treatment includes heat treatment, shot blasting or grinding to expose the hard particles, or dressing to obtain precision of size and profile. With these examples, numerous other treatments will suggest themselves to those skilled in the art.

With the above description in mind, the novel and innovative features of the present invention should be understood. In all the embodiments of the invention, the cellular carrier includes a skeleton that provides mechanical support for the hard particles of the material. The skeleton may take the form of the egg-crate shown in several of the drawings, or may be wires as shown in FIGS. 13 and 14, or may be grains of powder or fibers that constitute the carrier itself. For example, a preformed matrix of metal fiber, metal powder, or a powder-fiber combination, can have the hard particles urged thereinto, then the matrix can be sintered, with or without pressure, or brazed or plasma sprayed. The metal grains or fibers of the matrix, in this instance, can serve the function of the skeleton of the carrier.

Whatever form the skeleton of the carrier takes, the skeleton provides mechanical support for the hard particles, either directly, or indirectly through the matrix, to assist in holding the particles against forces that will tend to remove the particles from the composite material. Additionally, the skeleton can be used to transfer heat from the hard particles and composite material. It will be recognized that some of the hard particles, such as diamond, are good conductors of heat; therefore, by placing a skeleton of metal in juxtaposition with the particles, heat can be efficiently removed from the material. If the chosen hard particles are not good conductors of heat, the skeleton may be even more important as a means to remove heat.

The selection and arrangement of the hard particles is also subject to considerable variation. The composite material may be made with a single size of particles, or with a mixture of different sizes, in one piece of material, and with a single type, or a mixture of several types in one piece of material. A single layer may have a single size and type of particle, with successive layers of different sizes and types, or each layer may be of mixed sizes and types. Of course, a material such as that shown in FIG. 6 may be made with a generally homogeneous mixture of particles of different sizes and types so there is no specific arrangement of the specific types and sizes of particles. Those skilled in the art will understand that the particular characteristics of an abrasive tool or abrasive surface can be determined through proper selection of specific hard particles, and sizes of hard particles for specific sections or layers of the composite material.

In using abrasives or cutting materials as shown in FIGS. 2–5 of the drawings, only the hard particles will contact the surface being worked. This significantly reduces the frictional drag, so the cutting or polishing is more efficient than with materials wherein the cellular carrier or the matrix contacts the work piece.

Those skilled in the art will realize that some portion of the hard particles must be embedded in the matrix material to provide enough holding force for the composite material to be useful. As is shown in the drawings, the particles may be completely encapsulated within the matrix material, so the particle engages the work piece only after wearing away some of the matrix material. This arrangement provides the most durable structure. For greater efficiency, as was mentioned above, the particles may protrude from the matrix material. The maximum protrusion to provide a usable tool is about three-fourths of the particle size, that is to say, one-fourth of the volume of the particle is embedded in the matrix material, and three-fourths protrudes therefrom. The particles should have about one-fourth of the particle protruding from the matrix material for more durable tools.

As the particles extend farther from the matrix material, the tool becomes more aggressive but less durable. To render the tool more durable, the distance between the surface of the matrix and the tips of the particles should be carefully controlled. The distance should preferably range from about one-third of the size of the particles, to about one one-hundredth of the particle size. This range yields a highly durable tool.

It will therefore be seen that the present invention provides a composite material that may contain any desired concentration of diamonds or other hard particles for grinding, machining or polishing or resisting wear. A cellular carrier material has a skeleton that supports the hard particles for providing a durable material. A matrix material secures the particles within the carrier, and may extend beyond the carrier. The matrix material can be any of a wide variety of materials.

It will therefore be understood by those skilled in the art that the embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a composite material for producing abrasive and wear resistant parts, said composite material including a carrier, and a plurality of hard particles fixed with respect to said carrier for providing an abrasive quality of the carrier, the improvement wherein said carrier consists of a cellular material comprising a skeleton defining a plurality of cells within said carrier, said plurality of hard particles being primarily received within said cells of said carrier, and matrix means for holding said hard particles within said cells.

2. In a composite material as claimed in claim 1, the further improvement wherein each hard particle of said plurality of hard particles is received within one cell of said plurality of cells, the arrangement being such that each hard particle of said plurality of hard particles is mechanically supported by a portion of said skeleton.

3. In a composite material as claimed in claim 2, the improvement wherein said plurality of hard particles are fixed to said skeleton, and said hard particles and said skeleton are encapsulated in said matrix material.

4. In a composite material as claimed in claim 2, the further improvement wherein at least some of said hard particles partially protrude from said cells.

5. In a composite material as claimed in claim 4, said hard particles having up to three-fourths of the particle protruding from said cells, said matrix means encapsulating the portion of said hard particle that is within said cell.

6. In a composite material as claimed in claim 5, said hard particles having from one one-hundredth to one-third of the particle protruding from the cells.

7. In a composite material as claimed in claim 1, at least one cell of said plurality of cells receiving a plurality of said hard particles, said matrix means encapsulating said plurality of hard particles for retaining said hard particles within said cell.

8. In a composite material as claimed in claim 7, some hard particles of said plurality of hard particles protruding from said cells and said matrix means.

9. In a composite material as claimed in claim 7, some hard particles of said plurality of hard particles being fixed to said skeleton.

10. In a composite material as claimed in claim 7, said hard particles having up to three-fourths of the particle protruding from said cells, said matrix means encapsulating the portion of hard particle that is within said cell.

11. In a composite material as claimed in claim 10, said hard particles having from one one-hundredth to one-third of the particle protruding from the cells.

12. In a composite material as claimed in claim 1, the improvement wherein each cell of said plurality of cells is smaller than each particle of said plurality of hard particles, said cellular material being deformed for receiving said particles therein.

13. In a composite material as claimed in claim 1, said carrier being flexible so that said composite material is flexible.

14. In a composite material as claimed in claim 1, said carrier being rigid so that said composite material is rigid.

15. In a composite material as claimed in claim 1, the further improvement including a substrate fixed to said composite material.

16. In a composite material as claimed in claim 15, the improvement wherein said substrate consists of a cellular material.

17. In a composite material as claimed in claim 16, the further improvement wherein said substrate is formed of the same cellular material as said composite material.

18. In a composite material as claimed in claim 1, the improvement wherein, selectively, the concentration and the type of said hard particles is non-uniform throughout said composite material.

19. In a composite material as claimed in claim 1, the improvement wherein said plurality of cells in said carrier are non-uniform in size throughout said composite material.

20. In a composite material for producing abrasive and wear resistant parts, said composite material including a carrier, and a plurality of hard particles fixed with respect to said carrier for providing an abrasive quality of the carrier, said carrier consisting of a cellular material comprising a skeleton defining a plurality of cells within said carrier, said plurality of hard particles being received within said cells of said carrier, and matrix means for holding said hard particles within said cells, and a tool having a working surface, said composite material being shaped to conform to said working surface of said tool, and means for fixing said composite material to said tool.

21. The claimed in claim 20, wherein said carrier is flexible, said tool has a curved working surface, and said composite material is conformed to said curved working surface.

22. The as claimed in claim 20, wherein said carrier is rigid, said tool has a flat working surface, and said composite material is shaped to conform to said flat working surface.

23. The composite as claimed in claim 20, said composite material and said working surface defining openings.

* * * * *

US005049165B1

REEXAMINATION CERTIFICATE (2683th)

United States Patent [19]

Tselesin

[11] B1 5,049,165

[45] Certificate Issued Sep. 26, 1995

[54] COMPOSITE MATERIAL

[75] Inventor: Naum N. Tselesin, Atlanta, Ga.

[73] Assignee: Ultimate Abrasive Systems, Inc., Atlanta, Ga.

Reexamination Request
No. 90/003,403, Apr. 18, 1994

Reexamination Certificate for:

| | |
|---|---|
| Patent No.: | **5,049,165** |
| Issued: | **Sep. 17, 1991** |
| Appl. No.: | **467,958** |
| Filed: | **Jan. 22, 1990** |

Related U.S. Application Data

[63] Continuation-in-part of Ser. No. 303,924, Jan. 30, 1989, Pat. No. 4,925,457.

[51] Int. Cl.[6] ..... B24D 11/00

[52] U.S. Cl. ..... 51/295; 51/296; 51/308; 51/309

[58] Field of Search ..... 51/295, 296, 308, 51/309

[56] References Cited

U.S. PATENT DOCUMENTS

| | | | |
|---|---|---|---|
| 2,268,663 | 1/1942 | Kuzmick | 51/206 |
| 2,811,960 | 2/1957 | Fessel | 125/15 |
| 2,867,086 | 3/1959 | Raymond | 51/295 |
| 3,127,715 | 4/1964 | Christensen | 51/206 |
| 3,276,852 | 10/1966 | Lemelson | 51/298 |
| 3,860,400 | 1/1975 | Prowse et al. | 51/295 |
| 4,680,199 | 7/1987 | Vontell et al. | 427/199 |
| 4,925,457 | 5/1990 | deKok et al. | 51/293 |
| 4,949,511 | 8/1990 | Endo et al. | 51/295 |
| 5,092,910 | 3/1992 | deKok et al. | 51/295 |

FOREIGN PATENT DOCUMENTS

| | | |
|---|---|---|
| 0086086 | 8/1983 | European Pat. Off. . |
| 0238434 | 9/1987 | European Pat. Off. . |
| 0294198 | 3/1994 | European Pat. Off. . |
| 2029390 | 10/1970 | France . |
| 2565870 | 12/1985 | France . |

*Primary Examiner*—Deborah Jones

[57] ABSTRACT

A composite material is formed of a carrier having a cellular structure and diamonds or other hard, abrasive particles received within the cellular structure. A matrix material holds the diamonds in the carrier, and the matrix material may be the carrier itself or an additional substance such as a metal powder or resin. The diamonds may protrude from the composite material for aggressive working, or may be embedded for longer life of the material. The cellular carrier has a skeleton that protects and mechanically supports the diamonds within the composite material for greater durability of the composite material.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 23 is cancelled.

Claims 1–22 are determined to be patentable as amended.

New claims 24–36 are added and determined to be patentable.

1. In a composite material for producing abrasive and wear resistant parts, said composite material including a carrier, and a plurality of hard particles fixed with respect to said carrier for providing an abrasive *and a wear resistant* quality [of] *to* the carrier, the improvement wherein said carrier consists of a cellular material comprising a skeleton defining a plurality of cells within said carrier, said plurality of hard particles being primarily received within said cells of said carrier, and *a sintered* matrix [means for] *material* holding said hard particles within said cells, *said sintered matrix material being formed by sintering a sinterable matrix material under pressure and having a porosity of less than 5%.*

2. In a composite material as claimed in claim 1, [the further improvement] wherein each hard particle of said plurality of hard particles is received within one cell of said plurality of cells, the arrangement being such that each hard particle of said plurality of hard particles is mechanically supported by a portion of said skeleton.

3. In a composite material as claimed in claim 2, [the improvement] wherein said plurality of hard particles are fixed to said skeleton, and said hard particles and said skeleton are encapsulated in said *sintered* matrix material.

4. In a composite material as claimed in claim 2, [the further improvement] wherein at least some of said hard particles partially protrude from said cells.

5. In a composite material as claimed in claim 4, *wherein* said hard particles [having] *have* up to three-fourths of the particle protruding from said cells, *and* said *sintered* matrix [means encapsulating] *material encapsulates* the portion of said hard particle that is within said cell.

6. In a composite material as claimed in claim 5, *wherein* said hard particles [having] *have* from one one-hundredth to one-third of the particle protruding from the cells.

7. In a composite material as claimed in claim 1, *wherein* at least one cell of said plurality of cells [receiving] *receives* a plurality of said hard particles, *and* said *sintered* matrix [means encapsulating] *material encapsulates* said plurality of hard particles [for retaining] *to retain* said hard particles within said cell.

8. In a composite material as claimed in claim 7, *wherein* some hard particles of said plurality of hard particles [protruding] *protrude* from said cells and said *sintered* matrix [means] *material.*

9. In a composite material as claimed in claim 7, *wherein* some hard particles of said plurality of hard particles [being] *are* fixed to said skeleton.

10. In a composite material as claimed in claim 7, *wherein* said hard particles [having] *have* up to three-fourths of the particle protruding from said cells, *and* said *sintered* matrix [means encapsulating] *material encapsulates* the portion of hard particle that is within said cell.

11. In a composite material as claimed in claim 10, *wherein* said hard particles [having] *have* from one one-hundredth to one-third of the particle protruding from the cells.

12. In a composite material as claimed in claim 1, [the improvement] wherein each cell of said plurality of cells is smaller than each particle of said plurality of hard particles, *and* said cellular material [being] *is* deformed [for] *upon* receiving said particles therein.

13. In a composite material as claimed in claim 1, *wherein* said carrier [being] *is* flexible [so that], *and* said composite material is flexible.

14. In a composite material as claimed in claim 1, *wherein* said carrier [being] *is* rigid [so that], *and* said composite material is rigid.

15. In a composite material as claimed in claim 1, [the further improvement including] *wherein* a substrate *is* fixed to said composite material.

16. In a composite material as claimed in claim 15, [the improvement] wherein said substrate consists of a cellular material.

17. In a composite material as claimed in claim 16, [the further improvement] wherein said substrate is formed of the same cellular material as said [composite material] *carrier.*

18. In a composite material as claimed in claim 1, [the improvement] wherein, selectively, the concentration and the type of said hard particles [is] *are* non-uniform throughout said composite material.

19. In a composite material as claimed in claim 1, [the improvement] wherein said plurality of cells in said carrier are non-uniform in size throughout said composite material.

20. [In] *An assembly comprising* a composite material for producing abrasive and wear resistance parts, said composite material including a carrier, and a plurality of hard particles fixed with respect to said carrier for providing an abrasive *and wear resistant* quality [of] *to* the carrier, said carrier consisting of a cellular material comprising a skeleton defining a plurality of cells within said carrier, said plurality of hard particles being received within said cells of said carrier, *and a sintered* matrix [means for] *material* holding said hard particles within said cells, *said sintered matrix material being formed by sintering a sinterable matrix material under pressure and having a porosity of less than 5%*, and a tool having a working surface, said composite material being shaped to conform to said working surface of said tool, and means for fixing said composite material to said tool.

21. The *assembly as* claimed in claim 20, wherein said carrier is flexible, said tool has a curved working surface, and said composite material is conformed to said curved working surface.

22. The *assmebly* as claimed in claim 20, wherein said carrier is rigid, said tool has a flat working surface, and said composite material is shaped to conform to said flat working surface.

*24. The composite material of claim 1, wherein the particles are of the same size throughout the composite material.*

*25. A tool comprising a plurality of layers of the composite material of claim 1 bonded together, wherein the type, size and concentration of said particles throughout said tool are non-uniform.*

*26. The composite material of claim 1, wherein said sintered matrix material is integral with or in addition to said carrier.*

*27. The composite material of claim 1, wherein said cellular carrier material is selected from the group consisting of a metallic material, cemented carbides, ceramics, and organic and fiber graphite material.*

*28. The composite material of claim 1, wherein said cellular carrier material comprises a preformed matrix of sinterable metal fiber or metal powder or mixtures thereof.*

*29. The composite material of claim 1, wherein said cellular carrier material comprises a wire mesh or expanded metal material.*

*30. The composite material of claim 1, wherein said cells of said cellular material are open only on one side of said cellular material.*

*31. The composite material of claim 1, wherein said hard particles are selected from the group consisting of diamonds, carbides, and nitrides.*

*32. The composite material of claim 1, wherein said hard particles are a mixture of different abrasive materials.*

*33. A tool comprising a layer of the composite material of claim 1 integral with a layer of a sintered material.*

*34. The tool of claim 33, including a plurality of hard particles randomly distributed within said layer of said sintered material.*

*35. The tool of claim 34, comprising a layer of composite material integral with both sides of said layer of sintered material.*

*36. In a composite material for producing abrasive and wear resistant parts, said composite material including a carrier, and a plurality of hard particles fixed with respect to said carrier for providing an abrasive and a wear resistant quality of the carrier, the improvement wherein said carrier consists of a cellular material comprising a skeleton defining a plurality of cells within said carrier, said plurality of hard particles being primarily received within said cells of said skeleton, and a sintered matrix material holding said hard particles within said cells, said sintered matrix material being formed by sintering a sinterable matrix material under pressure and having a porosity of less than 50% wherein the pores thereof are filled with a material that is different from said sintered matrix material.*

* * * * *